US011367375B2

(12) United States Patent
Jeon et al.

(10) Patent No.: US 11,367,375 B2
(45) Date of Patent: Jun. 21, 2022

(54) DATA PROCESSING DEVICE AND DISPLAY DEVICE

(71) Applicant: LX Semicon Co., Ltd., Daejeon (KR)

(72) Inventors: Jae Uk Jeon, Daejeon (KR); Jung Bae Yun, Daejeon (KR); Man Jeong Ko, Daejeon (KR); Byung Seob Song, Daejeon (KR)

(73) Assignee: LX Semicon Co., Ltd., Daejeon (KR)

( * ) Notice: Subject to any disclaimer, the term of this patent is extended or adjusted under 35 U.S.C. 154(b) by 0 days.

(21) Appl. No.: 17/511,457

(22) Filed: Oct. 26, 2021

(65) Prior Publication Data

US 2022/0157216 A1 May 19, 2022

(30) Foreign Application Priority Data

Nov. 19, 2020 (KR) ..... 10-2020-0155764

(51) Int. Cl.
*G09G 3/20* (2006.01)

(52) U.S. Cl.
CPC ..... *G09G 3/20* (2013.01); *G09G 2310/0243* (2013.01); *G09G 2310/0267* (2013.01); *G09G 2310/06* (2013.01); *G09G 2310/08* (2013.01); *G09G 2320/043* (2013.01)

(58) Field of Classification Search
CPC ..... G09G 3/20; G09G 2310/0243; G09G 2310/0267; G09G 2310/06; G09G 2310/08
See application file for complete search history.

(56) References Cited

U.S. PATENT DOCUMENTS

| | | | | |
|---|---|---|---|---|
| 8,022,915 | B2 | 9/2011 | Lee et al. | |
| 8,334,830 | B2 | 12/2012 | Lee et al. | |
| 9,570,029 | B2 | 2/2017 | Kim et al. | |
| 2004/0189573 | A1 | 9/2004 | Lee et al. | |
| 2011/0267335 | A1 | 11/2011 | Lee et al. | |
| 2012/0200483 | A1* | 8/2012 | Moon | G09G 5/18 345/99 |
| 2013/0038587 | A1* | 2/2013 | Song | G09G 3/20 345/204 |
| 2013/0038639 | A1* | 2/2013 | Han | G09G 3/20 345/204 |
| 2016/0189653 | A1 | 6/2016 | Kim et al. | |

FOREIGN PATENT DOCUMENTS

| | | | |
|---|---|---|---|
| KR | 10-0687336 | B1 | 2/2007 |
| KR | 10-1078549 | B1 | 11/2011 |
| KR | 10-1537415 | B1 | 7/2015 |
| KR | 10-2016-0083565 | A | 7/2016 |
| KR | 10-1957737 | B1 | 3/2019 |

* cited by examiner

*Primary Examiner* — Sejoon Ahn
(74) *Attorney, Agent, or Firm* — Fenwick & West LLP

(57) ABSTRACT

The present embodiment relates to a data processing device and a display device and, more specifically, to data processing device and a display device for selectively applying an image quality improvement function in consideration of the characteristics depending on the positions on a display panel.

12 Claims, 8 Drawing Sheets

DATA PROCESSING DEVICE AND DISPLAY DEVICE

CROSS REFERENCE TO RELATED APPLICATION

This application claims priority from Republic of Korea Patent Application No. 10-2020-0155764, filed on Nov. 19, 2020, which is hereby incorporated by reference in its entirety.

BACKGROUND

1. Field of Technology

The present embodiment relates to a data processing device and a display device.

2. Description of the Prior Art

A plurality of data lines and gate lines may be arranged on a display panel, and pixels may be defined at intersections of the data lines and the gate lines.

Each pixel includes a transistor, which is turned on by a gate signal supplied to a gate line.

When the transistor is turned on, the data line is connected to the pixel so that a data voltage is supplied to the pixel. In addition, the brightness of the pixel varies depending on the magnitude of the data voltage, thereby displaying an image on the display panel.

Here, the gate signal may be affected by a kick back voltage due to a parasitic capacitance between the gate line and a gate node of the transistor.

In addition, if one or more of the size and resolution of the display panel increases, the load of the display panel may increase, which may lower a slew rate of the gate signal.

The above kick back phenomenon or reduction in the slew rate may cause a flicker, an afterimage, and luminance imbalance in the image displayed on the display panel.

In other words, the image quality may be degraded due to an image quality deterioration phenomenon caused by the gate signal, such as a kick back phenomenon, reduction in the slew rate, and the like.

In order to minimize the image quality deterioration phenomenon, an image quality improvement function of applying, to the gate signal, gate pulse modulation (GPM) that reduces the slope of a falling edge of the gate signal or further applying one or more of an overdrive voltage and an underdrive voltage to the basic voltage of the gate signal.

Here, if one or more of the size and resolution of the display panel is increased, the number of gate driving integrated circuits (ICs) supplying gate signals to the display panel is increased.

In addition, the image quality improvement function is simultaneously applied to a number of gate driving ICs.

As the display panel becomes larger, the degree of image quality deterioration may be different between the panel positions covered by a plurality of gate driving ICs. Therefore, the existing method of simultaneously applying the image quality improvement function to multiple gate driving ICs is not able to sufficiently prevent the image quality deterioration phenomenon that occurs differently between the panel positions.

SUMMARY OF THE INVENTION

Against this background, the present disclosure provides a technique for selectively applying an image quality improvement function in consideration of the positional characteristics on a display panel.

In view of the foregoing, in one aspect, the present embodiment provides a data processing device including: a clock generating circuit configured to generate a gate clock signal and to transmit the same to a first gate driving integrated circuit (IC) and a second gate driving IC; and a first control signal generating circuit configured to generate an operation control signal, which activates only a first image quality improving circuit included in the first gate driving IC during a first time section during which the first gate driving IC outputs a first gate signal according to the gate clock signal and deactivates both a second image quality improving circuit included in the second gate driving IC and the first image quality improving circuit during a second time section during which the second gate driving IC outputs a second gate signal according to the gate clock signal, and to transmit the operation control signal to the first gate driving IC and the second gate driving IC through a common signal line connected to the first gate driving IC and the second gate driving IC.

In another aspect, the present embodiment provides a display device including: a first gate driving integrated circuit (IC) including a first gate signal generating circuit configured to output a first gate signal according to a gate clock signal during a first time section and a first image quality improving circuit configured to improve an image quality which has deteriorated due to the first gate signal by modifying a pulse waveform of the first gate signal; a second gate driving IC including a second gate signal generating circuit configured to output a second gate signal according to the gate clock signal during a second time section subsequent to the first time section and a second image quality improving circuit configured to improve an image quality which has deteriorated due to the second gate signal by modifying a pulse waveform of the second gate signal; and a data processing device configured to generate the gate clock signal and to transmit the same to the first gate driving IC and the second gate driving IC, and configured to generate an operation control signal, which activates only a first image quality improving circuit during the first time section and deactivates both the first image quality improving circuit and the second image quality improving circuit during the second time section, and transmit the operation control signal to the first gate driving IC and the second gate driving IC through a common signal line connected to the first gate driving IC and the second gate driving IC.

The first image quality improving circuit may be configured to output a gate pulse modulation (GPM) signal to the first gate signal generating circuit to modify a pulse waveform of the first gate signal during the first time section.

The first image quality improving circuit may be configured to further apply one or more of an overdrive voltage and an underdrive voltage to a basic voltage of the first gate signal during the first time section, thereby modifying a pulse waveform of the first gate signal.

The operation control signal may include a pulse generation section corresponding to the first time section and a pulse non-generation section corresponding to the second time section.

The display device of claim may further include a display panel configured to receive the first gate signal from the first gate driving IC to display an image on a first display area during the first time section and to receive the second gate signal from the second gate driving IC to display an image on a second display area during the second time section.

The image quality deterioration phenomenon due to the first gate signal may occur, but the deteriorated image quality is improved by the first image quality improving circuit in the first display area, and the image quality deterioration phenomenon due to the second gate signal may not occur in the second display area.

As described above, according to the present embodiment, since the image quality improvement function is selectively applied depending on the panel position, it is possible to effectively improve the image quality deterioration phenomenon that occurs differently between the panel positions.

DETAILED DESCRIPTION OF THE EXEMPLARY EMBODIMENTS

Figure 1:
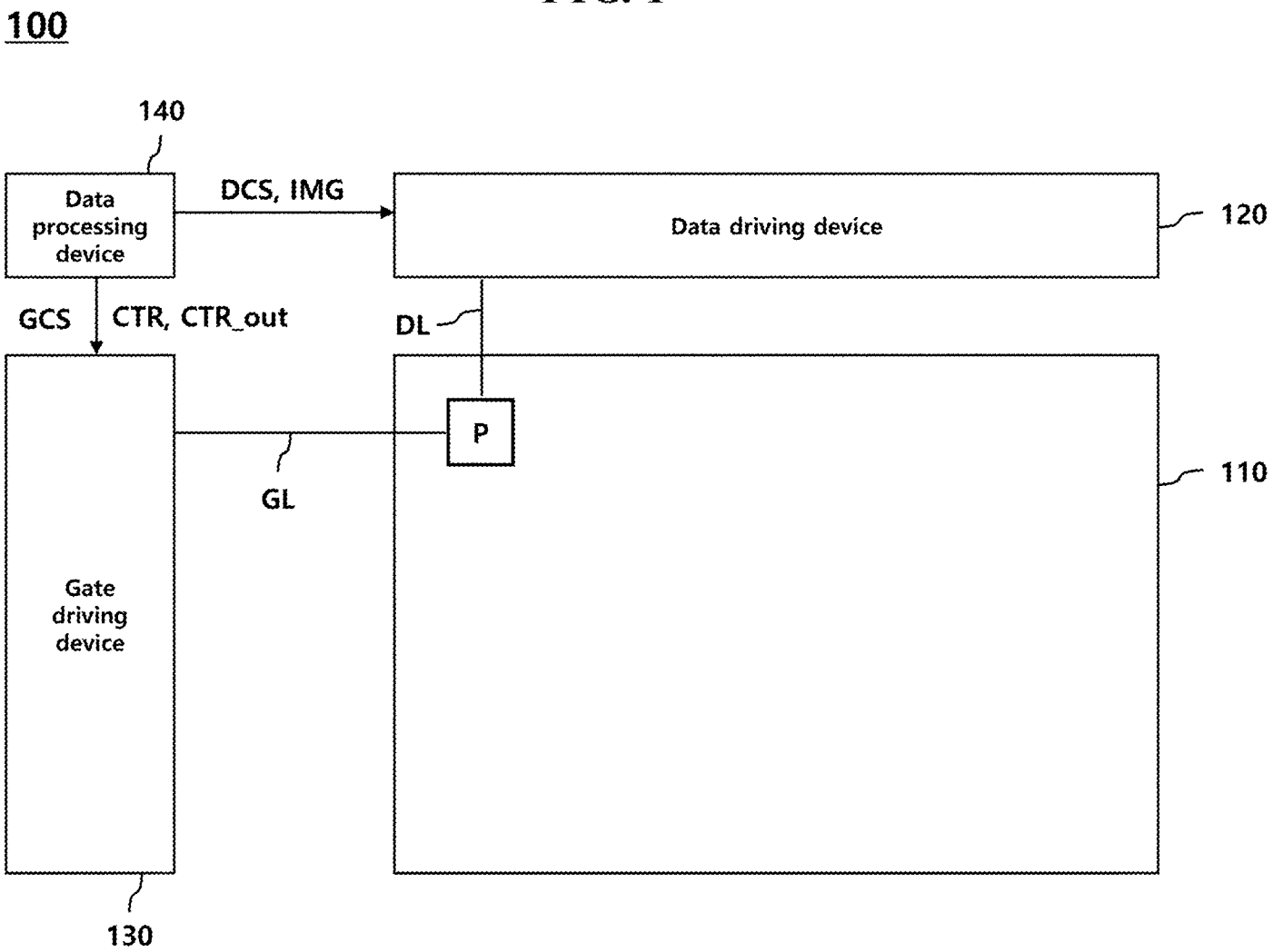
FIG. 1 is a diagram illustrating the configuration of a display device according to an embodiment.

FIG. 1 is a diagram illustrating the configuration of a display device according to an embodiment.

Referring to FIG. 1, a display device 100 may include a display panel 110, a data driving device 120, a gate driving device 130, a data processing device 140, and the like.

A plurality of data lines DL, a plurality of gate lines GL, and a plurality of pixels P may be arranged on the display panel 110.

The display panel 110 may be a liquid crystal display panel. The display panel 110 may be another type of panel such as an organic light-emitting diode (OLED) panel.

The gate driving device 130 may supply a gate signal of a turn-on voltage or a turn-off voltage to the gate lines GL. If the gate signal of the turn-on voltage is supplied to a pixel P, the pixel P may be connected to the data line DL. In addition, if the gate signal of the turn-off voltage is supplied to the pixel P, the connection between the pixel P and the data line DL is released.

The gate driving device 130 described above may include a plurality of gate driving integrated circuits (ICs).

The data driving device 120 supplies a data voltage to the data line DL. The data voltage supplied to the data line DL may be supplied to the pixel P according to the gate signal.

The data driving device 120 described above may include a plurality of data driving ICs.

The data processing device 140 may transmit control signals to the gate driving device 130 and the data driving device 120. For example, the data processing device 140 may transmit, to the gate driving device 130, a gate control signal GCS for starting scanning. The gate control signal GCS may include a gate start pulse GSP and a gate clock signal GCLK. The gate start pulse GSP included in the gate control signal GCS may include a pulse for controlling the output timing of a first gate signal during one frame period.

The data processing device 140 may output image data IMG to the data driving device 120. In addition, the data processing device 140 may transmit a data control signal DCS that performs control such that the data driving device 120 supplies a data voltage to each pixel P.

In an embodiment, the data processing device 140 may transmit, to the gate driving device 130, an operation control signal for selectively activating the image quality improvement function provided in each of the plurality of gate driving ICs. In addition, the data processing device 140 may transmit, to the gate driving device 130, an output control signal for controlling the output of the image quality improvement function.

Hereinafter, a configuration in which the data processing device 140 selectively activates the image quality improvement function provided in each of a plurality of gate driving ICs will be described in detail.

Figure 2:
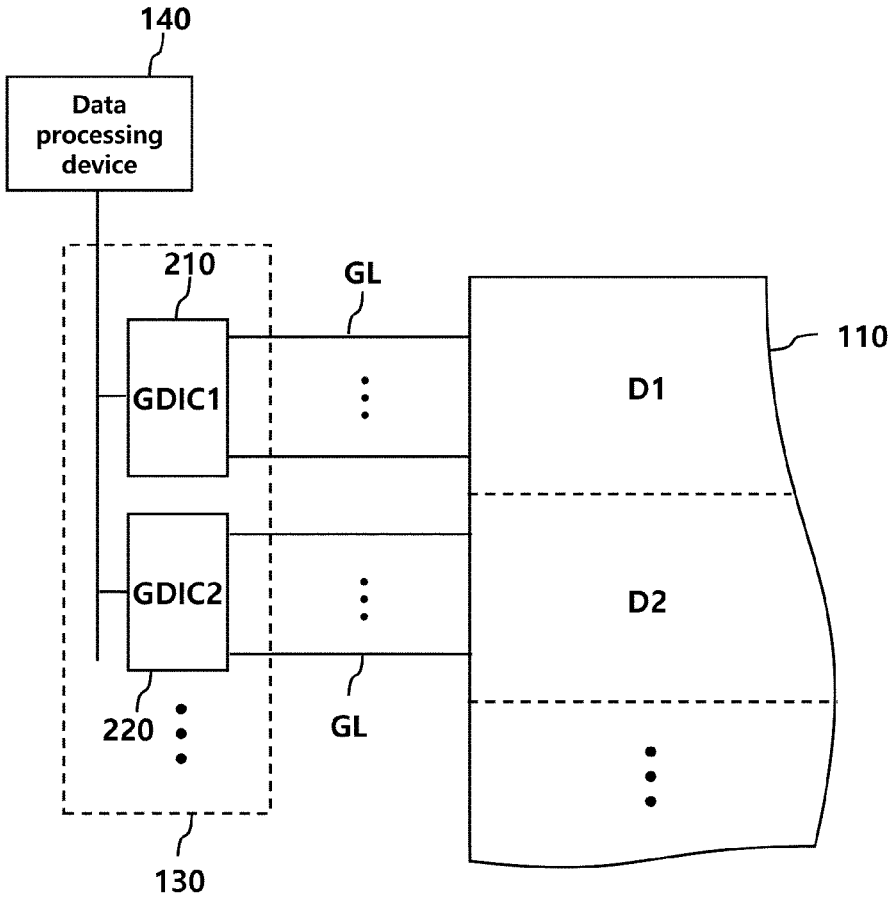
FIG. 2 is a diagram illustrating a data processing device, a gate driving device, and a display panel according to an embodiment.

FIG. 2 is a diagram illustrating a data processing device, a gate driving device, and a display panel according to an embodiment.

Referring to FIG. 2, the data processing device 140 may be connected to a plurality of gate driving ICs included in the gate driving device 130. Hereinafter, a description will be made on the assumption that the plurality of gate driving ICs is configured as a first gate driving IC 210 and a second gate driving IC 220.

The first gate driving IC 210 and the second gate driving IC 220 may transmit gate signals to different areas in the display panel 110.

For example, the first gate driving IC 210 may transmit a first gate signal to a first display area D1, and the second gate driving IC 220 may transmit a second gate signal to a second display area D2. Here, the first display area D1 and the second display area D2 may be obtained by dividing the display panel 110 in the horizontal direction.

In an embodiment, the display panel 110 may have an image quality deterioration phenomenon occurring differently between display areas due to the gate signals. For example, the first display area D1 may have an image quality deterioration phenomenon due to the first gate signal, whereas the second display area D2 may not have an image quality deterioration phenomenon due to the second gate signal.

In this case, the data processing device 140 may activate the image quality improvement function of the first gate driving IC 210 and deactivate the image quality improvement function of the second gate driving IC 220 during a first time section during which the first gate driving IC 210 transmits the first gate signal to the first display area D1. In addition, the data processing device 140 may deactivate both the image quality improvement function of the first gate driving IC 210 and the image quality improvement function of the second gate driving IC 220 during a second time section during which the second gate driving IC 220 transmits the second gate signal to the second display area D2.

Figure 3:
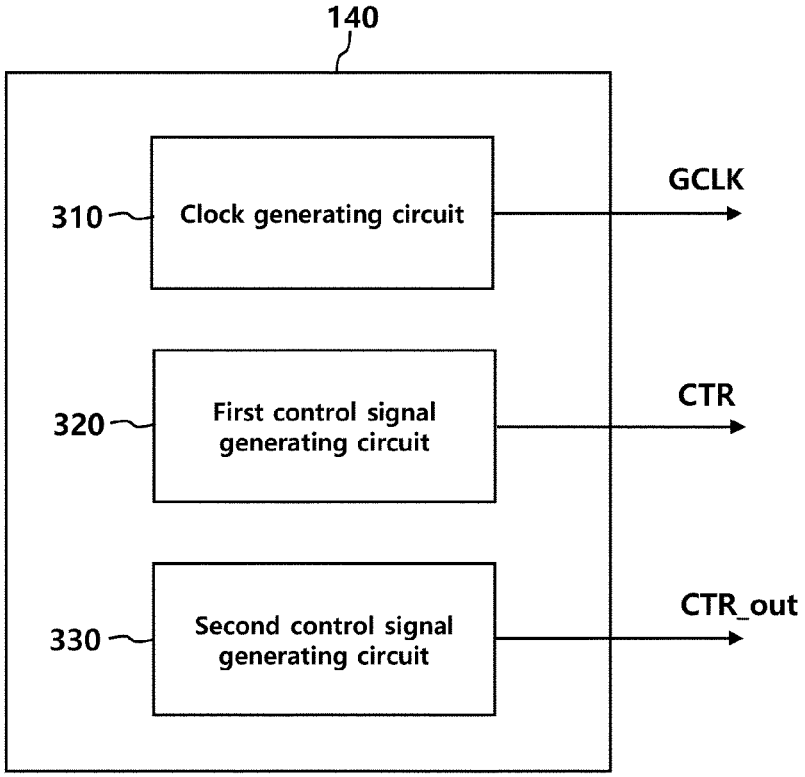
FIG. 3 is a diagram illustrating the configuration of a data processing device according to an embodiment.
Figure 4:
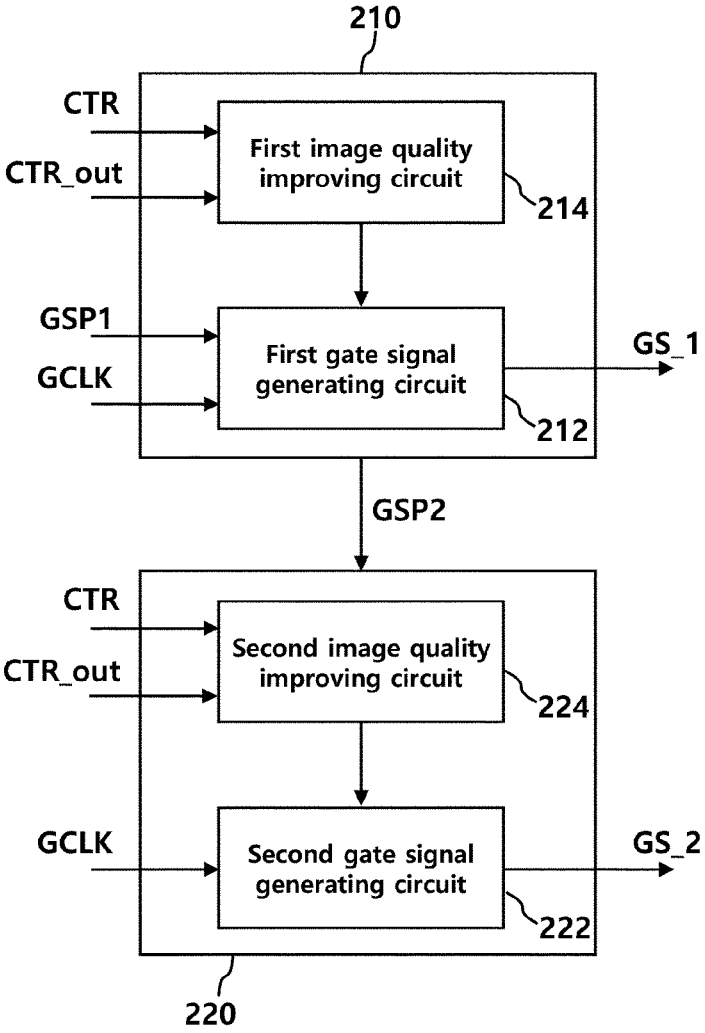
FIG. 4 is a diagram illustrating the configured of a gate driving IC according to an embodiment.

To this end, the data processing device 140 may include a clock generating circuit 310, a first control signal generating circuit 320, and a second control signal generating circuit 330 as shown in FIG. 3, and the first gate driving IC 210 may include a first gate signal generating circuit 212 and a first image quality improving circuit 214 as shown in FIG. 4. In addition, the second gate driving IC 220 may include a second gate signal generating circuit 222 and a second image quality improving circuit 214 as shown in FIG. 4.

In FIG. 3, the clock generating circuit 310 generates a gate clock signal GCLK and transmits the same to the first gate driving IC 210 and the second gate driving IC 220.

Figure 6:
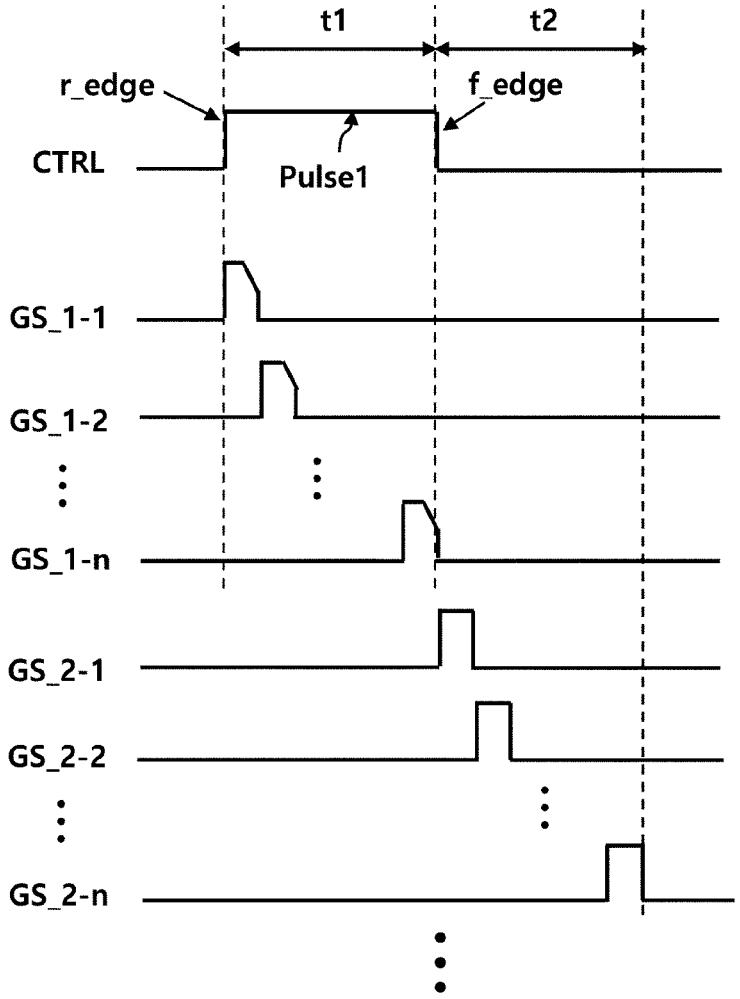
FIGS. 6, 7A, 7B, 7C, and 8 are diagrams illustrating a configuration for selectively applying an image quality improvement function in a display device according to an embodiment.

The first control signal generating circuit 320 generates an operation control signal CTR and transmits both to the first gate driving IC 210 and to the second gate driving IC 220. As shown in FIG. 6, the operation control signal CTR may be a control signal that activates only the first image quality improving circuit 214 of the first gate driving IC 210 during the first time section t1 during which the first gate driving IC 210 outputs the first gate signals (GS_1-1 to GS_1-*n* in FIG. 6) according to the gate clock signal GCLK, and deactivates both the second image quality improving circuit 224 of the second gate driving IC 220 and the first image quality improving circuit 214 during the second time section t2 during which the second gate driving IC 220 outputs the second gate signals (GS_2-1 to GS_2-*n* in FIG. 6) according to the gate clock signal GCLK.

The operation control signal may include a first pulse Pulse1 that activates only the first image quality improving circuit 214 during the first time section and include a pulse non-generation section corresponding to the second time section t2. In FIG. 6, a rising edge r_edge of the first pulse Pulse1 may be formed at the time point at which the first gate driving IC 210 outputs the first gate signal for the first time. In addition, a falling edge f_edge of the first pulse Pulse1 may be formed at the time point at which the first gate driving IC 210 completes outputting of the first gate signal.

In an embodiment, configuration information for generating the operation control signal CTR may be obtained through multiple tests of the display panel 110, and the first control signal generating circuit 320 may store configuration information in the manufacturing process of the display device 100.

In other words, the first control signal generating circuit 320 may generate the operation control signal CTR according to prestored configuration information.

The second control signal generating circuit 330 may generate an output control signal CTR_out for controlling the outputs of the first image quality improving circuit 214 and the second image quality improving circuit 224 and may transmit both to the first gate driving IC 210 and to the second gate driving IC 220.

Here, the output control signal CTR_out may be the signal that controls the output times, the output magnitudes, and the like of the first image quality improving circuit 214 and the second image quality improving circuit 224.

Since the first image quality improving circuit 214 is activated by the operation control signal CTR during the first time section, the first image quality improving circuit 214 may control the output time, the output magnitude, and the like according to the output control signal CTR_out. However, since the second image quality improving circuit 224 is deactivated by the operation control signal CTR, the second image quality improving circuit 224 does not control the output according to the output control signal CTR_out.

Meanwhile, in FIG. 4, the first gate signal generating circuit 212 of the first gate driving IC 210 may shift and output the first gate signal GS_1 according to the gate clock signal GCLK during the first time section t1 from the time of receiving the gate start pulse.

If the first gate driving IC 210 is adjacent to the data processing device 140, the first gate signal generating circuit 212 may receive a first gate start pulse GSP1 from the data processing device 140 as shown in FIG. 4.

Figure 5:
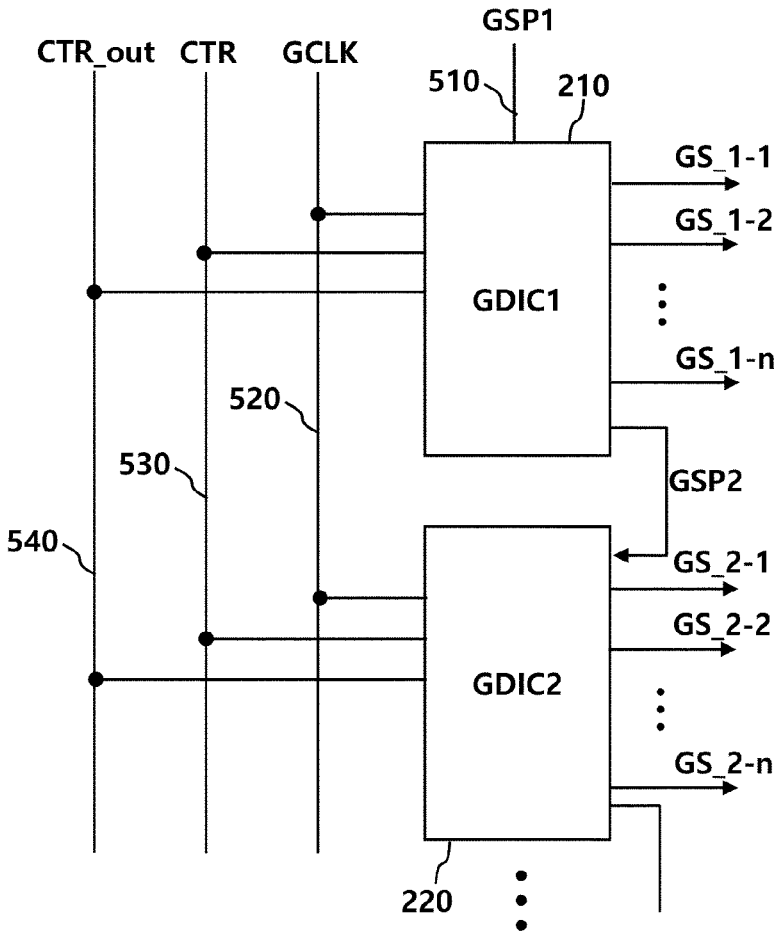
FIG. 5 is a diagram illustrating the configuration of a gate signal line according to an embodiment.

In addition, the first gate signal generating circuit 212 may receive the gate clock signal GCLK from the data processing device 140. The first gate signal generating circuit 212, as shown in FIG. 5, may receive the first gate start pulse GSP1 through a first signal line 510 and may receive the gate clock signal GCLK through the first common signal line 520.

The specific configuration in which the first gate signal generating circuit 212 outputs the first gate signal GS_1 is as follows.

The first gate signal generating circuit 212 may preferentially output a first gate signal GS_1-1 using the first gate start pulse GSP1 and the gate clock signal GCLK. In addition, the first gate signal generating circuit 212 may sequentially shift the phase of the first gate signal, which was output preferentially, thereby outputting a second GS_1-2 to an nth GS_1-*n* as shown in FIG. 6. According thereto, the first gate signal generating circuit 212 may sequentially transmit a plurality of phase-shifted first gate signals GS_1-1 to GS_1-*n* to the first display area D1.

The first gate signal generating circuit 212 may output a second gate start pulse GSP2 to the second gate driving IC 220 at the time of completing the output of the first gate signal GS_1, that is, at the time of outputting the nth signal GS_1-*n* of the first gate signal GS_1.

The first image quality improving circuit 214 may change the pulse waveform of the first gate signal GS_1, thereby improving image quality deteriorated due to the first gate signal. Here, the image quality deterioration phenomenon may be at least one of a kick back phenomenon and a slew rate reduction phenomenon.

In an embodiment, the first image quality improving circuit 214 may receive the operation control signal CTR from the data processing device 140 and may further receive the output control signal CTR_out. The first image quality improving circuit 214 may receive the operation control signal CTR through a second common signal line 530 and may receive the output control signal CTR_out through a third common signal line 540.

The first image quality improving circuit 214 may identify whether or not the first pulse Pulse1 is included in the operation control signal CTR.

In other words, the first image quality improving circuit 214 may identify whether or not the time, at which the rising edge r_edge of the pulse included in the operation control signal CTR is formed, and the time, at which the first gate signal GS_1 is initially output, are the same or whether or not the difference therebetween is within an error range.

As shown in FIG. 6, if the time at which the rising edge r_edge of the pulse is formed and the time at which the first gate signal GS_1 is initially output are the same or if the difference therebetween is within an error range, the first image quality improving circuit 214 may be activated according to the operation control signal CTR, thereby changing the pulse waveform of the first gate signal GS_1.

In an embodiment, the first image quality improving circuit 214 may output a gate pulse modulation GPM signal to the first gate signal generating circuit 212. Accordingly, the pulse waveform of the first gate signal GS_1 output from the first gate signal generating circuit 212 may be changed as shown in FIG. 6 during the first time section t1. As shown in FIG. 6, if the gradient of the falling edge in the pulse waveform of the first gate signal GS_1 is changed to be gent, the kick back phenomenon may be removed or alleviated, thereby preventing the image quality deterioration.

Figure 7A:
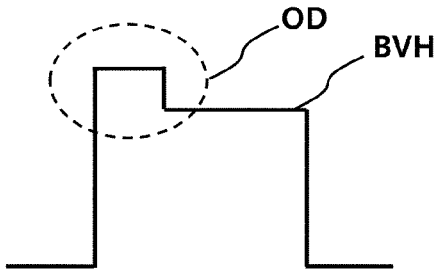
Figure 7B:
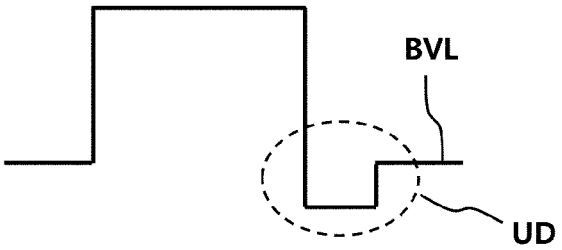
Figure 7C:
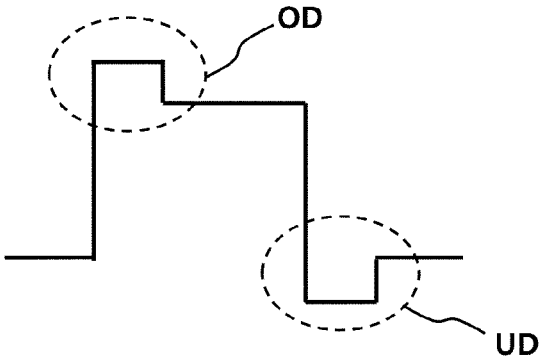

In an embodiment, the first image quality improving circuit 214 may further apply one or more of an overdrive voltage and an underdrive voltage to the basic voltage of the first gate signal GS_1 to change the pulse waveform of the first gate signal GS_1 as shown in FIGS. 7A, 7B, and 7C.

Specifically, the first image quality improving circuit 214 may further apply an overdrive voltage OD to the basic high voltage BVH of the first gate signal GS_1, thereby changing the pulse waveform of the first gate signal GS_1 as denoted in FIG. 7A.

The first image quality improving circuit 214 may further apply an underdrive voltage UD to the basic low voltage BVL of the first gate signal, thereby changing the pulse waveform of the first gate signal GS_1 as denoted in FIG. 7B.

In addition, the first image quality improving circuit 214 may further apply the overdrive voltage OD to the basic high voltage BVH of the first gate signal, and may further apply the underdrive voltage UD to the basic low voltage BVL, thereby changing the pulse waveform of the first gate signal GS_1 as denoted in FIG. 7C.

Accordingly, the slew rate of the gate signal GS_1 may be increased, thereby preventing the image quality deterioration due to the slew rate reduction phenomenon.

In FIG. 4, the second gate signal generating circuit 222 of the second gate driving IC 220 may output the second gate signal GS_2 according to the gate clock signal GCLK during the second time section t2 from time at which a second gate start pulse GSP2 is received from the first gate signal generating circuit 212. The second gate signal generating circuit 222 may receive the gate clock signal GCLK through the first common signal line 520 as shown in FIG. 5.

A detailed configuration in which the second gate signal generating circuit 222 outputs the second gate signal GS_2 will be described below.

The second gate signal generating circuit 222 may initially output the second gate signal GS_2-1 using the second gate start pulse GSP2 and the gate clock signal GCLK. In addition, the second gate signal generating circuit 222 may sequentially shift the phase of the second gate signal, which is initially output, and may output a second GS_2-2 to an nth GS_2-*n*, as shown in FIG. 6. According thereto, the second gate signal generating circuit 222 may sequentially supply a plurality of phase-shifted second gate signals GS_2-1 to GS_2-*n* to the second display area D2.

The second image quality improving circuit 224 may improve the image quality deterioration phenomenon due to the second gate signal GS_2 by changing the pulse waveform of the second gate signal GS_2.

In an embodiment, the second image quality improving circuit 224 may receive an operation control signal CTR from the data processing device 140, and may further receive an output control signal CTR_out. The second image quality improving circuit 224 may receive the operation control signal CTR through the second common signal line 530, and may receive the output control signal CTR_out through the third common signal line 540.

As described above, the first common signal line 520 to the third common signal line 540 cause the first gate driving IC 210 and the second gate driving IC 220 to receive, in common, signals from the data processing device 140.

Meanwhile, the second image quality improving circuit 224 may identify whether or not the time at which the rising edge r_edge of the pulse included in the operation control signal CTR is formed and the time at which the second gate signal GS_2 is initially output are the same or whether or not the difference therebetween is within an error range.

As shown in FIG. 6, if the time at which the rising edge r_edge of the pulse is formed and the time at which the second gate signal GS_2 is initially output are not the same, the second image quality improving circuit 224 may be deactivated according to the operation control signal CTR. In other words, the image quality improvement function of the second gate driving IC 220 may be deactivated by the operation control signal CTR.

As described above, since the display device 100 according to an embodiment is able to select one or more gate driving ICs, among a plurality of gate driving ICs, of which the image quality improvement function is to be activated depending on the characteristics of the display areas connected to the respective gate driving ICs, instead of simultaneously activating the image quality improvement function of the plurality of gate driving ICs, it is possible to effectively prevent the image quality deterioration phenomenon that occurs differently between positions on the display panel 110.

Figure 8:
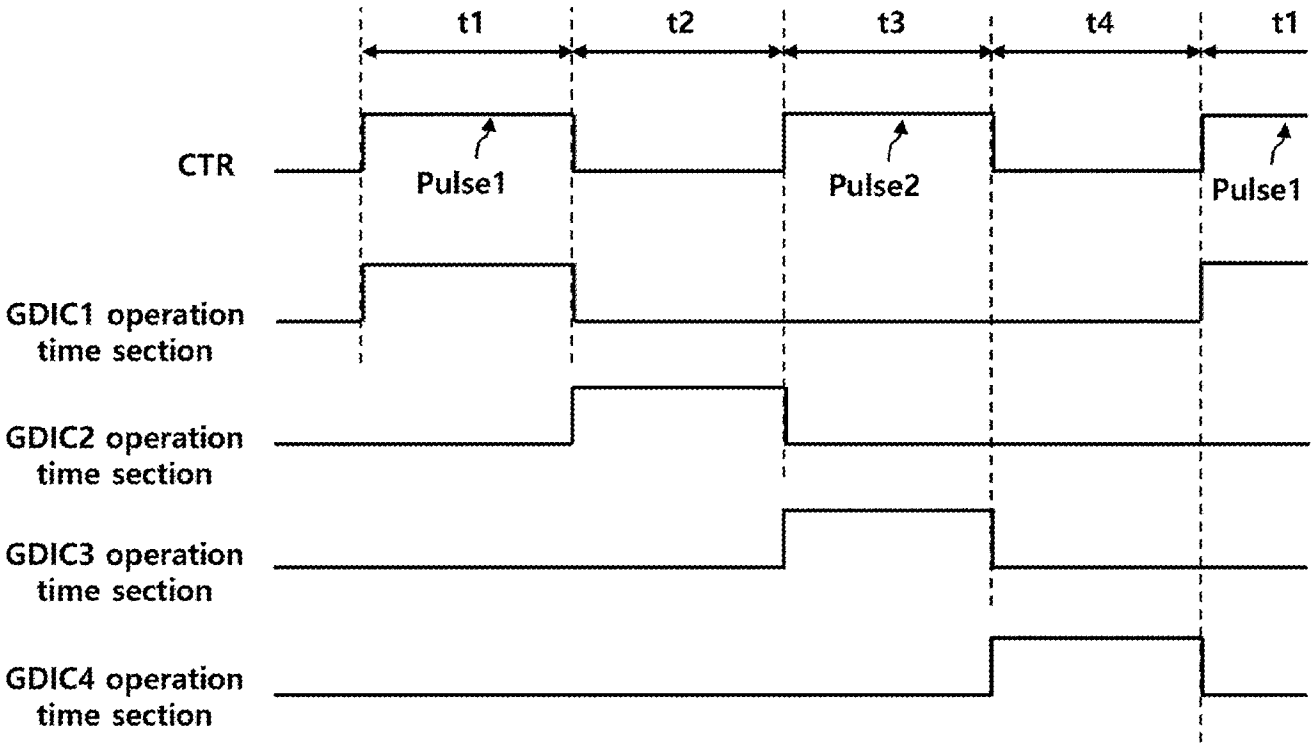

Meanwhile, it has been described in FIGS. 2 to 6 that the number of the gate driving ICs is limited to two and that the number of gate driving ICs activated according to the operation control signal CTR is limited to one. However, an embodiment is not limited thereto, and as shown in FIG. 8, the number of gate driving ICs may be three or more, and the number of gate driving ICs activated according to the operation control signal CTR may also be two or more (e.g., GDIC1 and GDIC3 in FIG. 8).

In addition, the operation control signal CTR may be repeated in units of frames of the image data IMG.

Specifically, the image quality improvement function of the GDIC1 may be activated according to the first pulse Pulse1 of the operation control signal CTR during the first time section t1, which is the operation time section of the GDIC1 in one frame, thereby improving the image quality of the display area to which the GDIC1 is connected.

Thereafter, the image quality improvement functions of all GDICs may be deactivated during the second time section t2, which is the operation time section of the GDIC2. In addition, during the third time section t3, which is the operation time section of the GDIC3, the image quality improvement function of the GDIC3 may be activated according to the second pulse Pulse2 of the operation control signal CTR, thereby improving the image quality of the display area to which the GDIC3 is connected.

Thereafter, the image quality improvement functions of all the GDICs may be deactivated again during the fourth time section t4, which is the operation time section of the GDIC4. In addition, the GDIC1 to GDIC4 may repeat the above configuration in the next frame.

What is claimed is:

1. A data processing device comprising:

a clock generating circuit configured to generate a gate clock signal and to transmit the same to a first gate driving integrated circuit (IC) and a second gate driving IC; and a first control signal generating circuit configured to generate an operation control signal, which activates only a first image quality improving circuit included in the first gate driving IC during a first time section during which the first gate driving IC outputs a first gate signal according to the gate clock signal and deactivates both a second image quality improving circuit included in the second gate driving IC and the first image quality improving circuit during a second time section during which the second gate driving IC outputs a second gate signal according to the gate clock signal, and to transmit the operation control signal to the first gate driving IC and the second gate driving IC through a common signal line connected to the first gate driving IC and the second gate driving IC.

2. The data processing device of claim 1, wherein the operation control signal comprises a pulse configured to activate only the first image quality improving circuit during the first time section, and wherein a rising edge of the pulse is formed at the time at which the first gate driving IC initially outputs the first gate signal and a falling edge of the pulse is formed at the time at which the first gate driving IC completes outputting the first gate signal.

3. The data processing device of claim 2, wherein the operation control signal comprises a pulse non-generation section corresponding to the second time section.

4. The data processing device of claim 1, further comprising a second control signal generating circuit configured to generate an output control signal for controlling outputs of the first image quality improving circuit and the second image quality improving circuit and to transmit the output control signal to the first gate driving IC and the second gate driving IC through another common signal line connected to the first gate driving IC and the second gate driving IC.

5. The data processing device of claim 4, wherein the first image quality improving circuit is configured to modify a pulse waveform of the first gate signal according to the output control signal during the first time section.

6. A display device comprising:

a first gate driving integrated circuit (IC) comprising a first gate signal generating circuit configured to output a first gate signal according to a gate clock signal during a first time section and a first image quality improving circuit configured to improve an image quality which has deteriorated due to the first gate signal by modifying a pulse waveform of the first gate signal;

a second gate driving IC comprising a second gate signal generating circuit configured to output a second gate signal according to the gate clock signal during a second time section subsequent to the first time section and a second image quality improving circuit configured to improve an image quality which has deteriorated due to the second gate signal by modifying a pulse waveform of the second gate signal; and a data processing device configured to generate the gate clock signal and to transmit the same to the first gate driving IC and the second gate driving IC and configured to generate an operation control signal, which activates only a first image quality improving circuit during the first time section and deactivates both the first image quality improving circuit and the second image quality improving circuit during the second time section, and to transmit the operation control signal to the first gate driving IC and the second gate driving IC through a common signal line connected to the first gate driving IC and the second gate driving IC.

7. The display device of claim 6, wherein the first image quality improving circuit is configured to output a gate pulse modulation (GPM) signal to the first gate signal generating circuit to modify a pulse waveform of the first gate signal during the first time section.

8. The display device of claim 6, wherein the first image quality improving circuit is configured to further apply one or more of an overdrive voltage and an underdrive voltage to a basic voltage of the first gate signal during the first time section, thereby modifying a pulse waveform of the first gate signal.

9. The display device of claim 6, wherein the operation control signal comprises a pulse generation section corresponding to the first time section and a pulse non-generation section corresponding to the second time section.

10. The display device of claim 6, further comprising a display panel configured to receive the first gate signal from the first gate driving IC to display an image on a first display area during the first time section and to receive the second gate signal from the second gate driving IC to display an image on a second display area during the second time section.

11. The display device of claim 10, wherein the image quality deterioration phenomenon due to the first gate signal occurs, but the deteriorated image quality is improved by the first image quality improving circuit in the first display area, and the image quality deterioration phenomenon due to the second gate signal does not occur in the second display area.

12. The display device of claim 6, wherein the image quality deterioration phenomenon comprises at least one of a kick back phenomenon and a slew rate reduction phenomenon.

* * * * *